US005666608A

United States Patent [19]

Christensen

[11] Patent Number: 5,666,608

[45] Date of Patent: Sep. 9, 1997

[54] CHARGING MEMBER AND IMAGE FORMING MEMBER SPACER APPARATUS

[75] Inventor: K. Trent Christensen, Boise, Id.

[73] Assignee: Hewlett-Packard Company, Palo Alto, Calif.

[21] Appl. No.: 642,150

[22] Filed: May 2, 1996

[51] Int. Cl.[6] ..... G03G 15/02

[52] U.S. Cl. ..... 399/176; 399/115; 399/50

[58] Field of Search ..... 399/176, 175, 399/174, 115, 50; 361/225

[56] References Cited

U.S. PATENT DOCUMENTS

| | | | |
|---|---|---|---|
| 5,095,335 | 3/1992 | Watanabe et al. | 355/210 |
| 5,227,851 | 7/1993 | Yoshida et al. . | |
| 5,430,527 | 7/1995 | Maruyama et al. . | |
| 5,465,136 | 11/1995 | Watanabe | 355/210 |

*Primary Examiner*—R. L. Moses
*Attorney, Agent, or Firm*—Gregg W. Wisdom

[57] ABSTRACT

A spacer apparatus for providing separation between a photoconductor drum and a charge roller in an electrophotographic printing system prior to first use includes a first and a second spacer member pivotally mounted to the shaft of the charge roller. Attached to the first and the second spacer members are, respectively, a first and a second spacer cam which contact the photoconductor drum in a region outside of the electrostatic latent image forming area of the photoconductor drum. Prior to the first rotation of the photoconductor drum, the first and second spacer cams maintain separation between the photoconductor drum and the charge roller. After the first rotation of the photoconductor drum, the first and second spacer cams rotate about the shaft of the charge roller and permit the charge roller to be engaged against the photoconductor drum by the compression springs.

20 Claims, 5 Drawing Sheets

CHARGING MEMBER AND IMAGE FORMING MEMBER SPACER APPARATUS

TECHNICAL FIELD

The present invention relates to electrophotographic image forming systems such as laser printers. More particularly, the present invention relates to the separation of the charging member and the image forming member within the electrophotographic image forming system to prevent damage to the image forming member.

BACKGROUND OF THE INVENTION

The most recent generation of electrophotographic printers and copiers employ charging members, such as a charge roller to perform the charging of the image forming member, such as a photoconductor (OPC) drum. Prior to the development of charge rollers, the OPC drum was charged using a corotron or a scorotron. Disadvantages of this older charging technology include the high voltages which must be generated to induce corona discharge, the charging inefficiency of corotron or scorotron drum charging devices, the ozone generated as a by-product of the corona discharge process, and the necessity of using discharge lamps to uniformly erase the OPC drum surface to eliminate the residual effects of the previous image.

Charge rollers offer improved performance over corotron or scorotron charging devices in each of these areas of deficiency. Because charge rollers operate in close proximity to the OPC drum, relative to corotron or scorotron devices, the voltages necessary to induce corona discharge are much lower than for corotron or scorotron devices. In addition, because charge rollers do not use a grid assembly to achieve charge uniformity on the OPC drum, they are much more efficient charging devices than corotrons or scorotrons. Furthermore, because charge rollers operate so that the corona discharge process occurs at lower voltages, the generation of ozone is substantially less than that of corotron or scorotron devices.

However, several quality and reliability problems, resulting from the use of charge rollers, have been recognized since charge rollers have experienced widespread use in electrophotographic cartridge products. To properly operate the charge roller it is necessary to locate it in close contact with the surface of the OPC drum. This is accomplished by applying a loading force to the charge roller which compresses it against the drum. This close contact allowed chemicals, released during or after the curing of the charge roller, to move onto the surface of the OPC drum. These solvent materials caused permanent degradation of the surface of the OPC drum. This problem resulted in a high rate of electrophotographic cartridge printing defects. The rate of occurrence of this problem was reduced by changes to the charge roller manufacturing process which reduced the amount of solvent used. However, the potential remains that with changes to the design or manufacturing process of the charge roller this problem would reappear.

Another problem which resulted from the use of charge rollers was also induced by the contact of the OPC drum and the charge roller. During shipping and handling of the electrophotographic cartridge, vibration and shock results in the charge roller moving over the surface of the OPC drum while it is in contact. This rubbing action induces charge in the outer charge transport layer of the OPC drum. The induced charge prevents the area which has experienced the rubbing action from discharging to the target voltage level during exposure of the OPC drum surface to form the latent electrostatic image. Many cycles of charge and discharge are required before the induced charge dissipates and the associated print defect is no longer visible. The resulting print defect can show up as light horizontal bands (for those printers which move the paper through the printer in the direction of the long dimension of the paper) across the page spaced by the circumference of the OPC drum. This problem continues to be a source of significant customer dissatisfaction requiring a solution.

SUMMARY OF THE INVENTION

This invention relates to a spacer apparatus which prevents damage to the image forming member by maintaining separation between the charging member and the image forming member when the electrophotographic image forming system is not in use. The spacer apparatus automatically eliminates the separation between the image forming member and the charging member at the beginning of use of the electrophotographic image forming system.

The spacer apparatus includes a spacer, having for example a first and a second spacer member, located between the charging member, such as a charge roller and the image forming member, such as a photoconductor drum in a first position. Also included in the spacer apparatus is a mechanism, for example a first and a second spacer cam attached to, respectively, the first and second spacer member, for moving the spacer from the first position to a second position as a result of rotation of the image forming member. In the second position the spacer is not located between the image forming member and the the charging member.

DESCRIPTION OF THE DRAWINGS

A more thorough understanding of the invention may be had from the consideration of the following detailed description taken in conjunction with the accompanying drawings in which.

DETAILED DESCRIPTION OF THE PREFERRED EMBODIMENT

The present invention is not limited to the specific exemplary embodiments illustrated herein. Although the spacer apparatus of this embodiment is discussed in the context of an electrophotographic print cartridge used in a laser printer, it will be recognized that the spacer apparatus of this embodiment has application in any electrophotographic image forming system in which separation of the image forming member and the charging member prior to operation of the printing system is of benefit.

Figure 1:
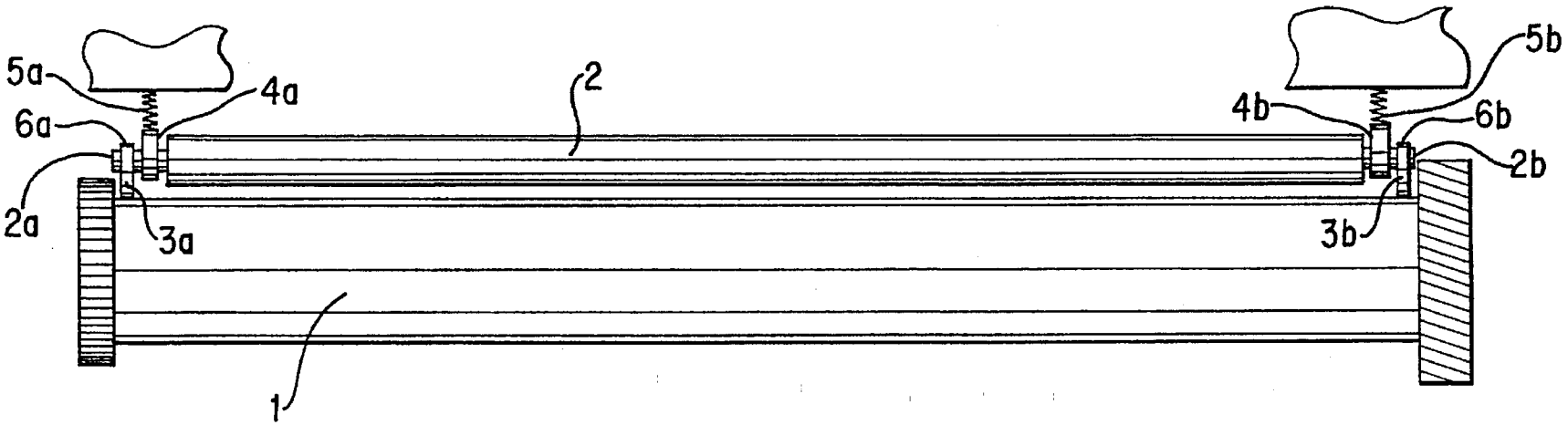
FIG. 1 is a drawing showing the relationship between some of the relevant components in an electrophotographic print cartridge and the spacer apparatus of this embodiment.

Shown in FIG. 1 is a representation of the relationship between the OPC DRUM 1, the charge roller 2, and spacers, including spacer members 6a, 6b and spacer cams 3a, 3b, of this embodiment. Charge roller holders 4a, 4b cradle the shaft ends 2a, 2b of charge roller 2. Compression springs 5a, 5b provide a loading force on charge roller holders 4a, 4b which, when spacer cams 3a, 3b are located in the operating position, compress charge roller 2 against OPC drum 1. The shaft ends 2a, 2b of charge roller 2 slide through holes in spacer members 6a, 6b. Prior to the first use of the electrophotographic cartridge, spacer cams 3a, 3b are engaged against OPC drum 1 and lift charge roller 2 off the surface of OPC drum 1, preventing contact between the OPC drum 1 and the charge roller 2. Spacer cams 3a 3b are joined to spacer members 6a, 6b. In the preferred embodiment, spacer cams 3a 3b are integrally formed with spacer members 6a, 6b.

It is important that spacer members 6a, 6b are located on shaft ends 2a, 2b so that the spacer cams 3a, 3b do not contact OPC drum 1 in an area which will be used for printing because of the wear on the surface of OPC drum 1 in the contact area. Spacer members 6a, 6b may, for example, be held in their proper location by changing the diameter of shaft ends 2a, 2b so that the diameter is larger than the diameter of the holes in spacer members 6a, 6b at locations on the shaft ends 2a, 2b which correspond to printable areas of OPC drum 1 or by forming bumps near shaft ends 2a, 2b to locate spacer members 6a, 6b in proximity to shaft ends 2a, 2b. Furthermore, it is also important that spacer cams 3a, 3b be constructed of a material which will not cause excessive abrasion of the surface of OPC drum 1 where there is contact between spacer cams 3a, 3b and OPC drum 1.

Figure 2:
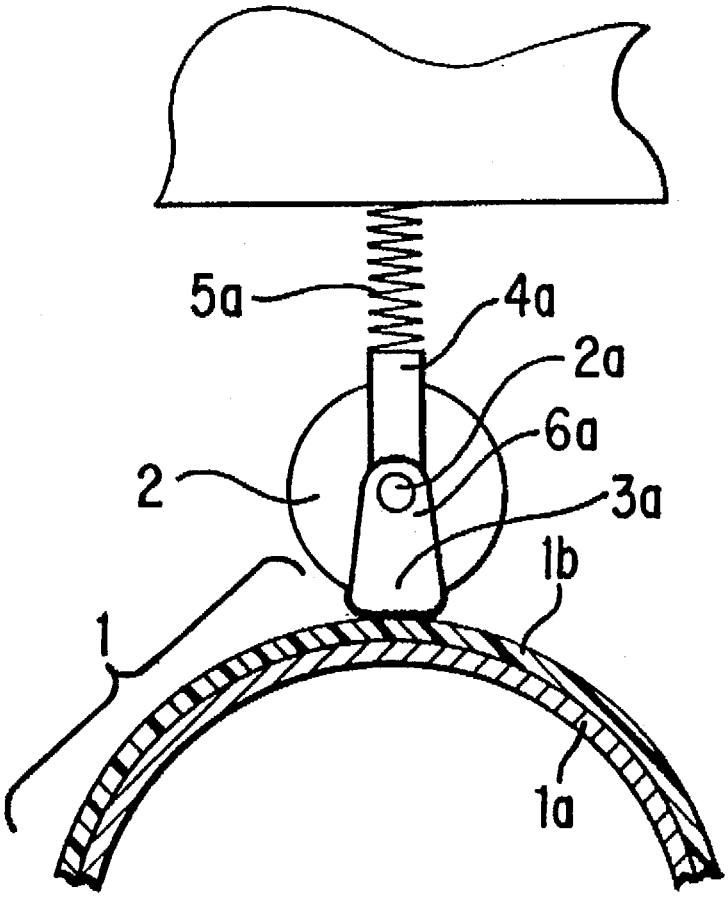
FIG. 2 is a drawing showing a cross section the OPC drum and a side view of the charge roller, charge roller mounting, and the spacer apparatus of this embodiment in the pre-use position as viewed from an end of the OPC drum.

Referring particularly to FIG. 2, shown is an end view of charge roller 2. OPC drum 1 is shown in cross section as including a substrate 1a, typically made of aluminum, and the photoconductive coatings 1b of the OPC drum 1. FIG. 2 shows the preferred embodiment of spacer cam 3a engaged against the surface of the photoconductive coatings 1b of OPC drum 1 in the position spacer cam 3a occupies, the pre-use position, prior to the first use of the electrophotographic print cartridge.

Figure 3:
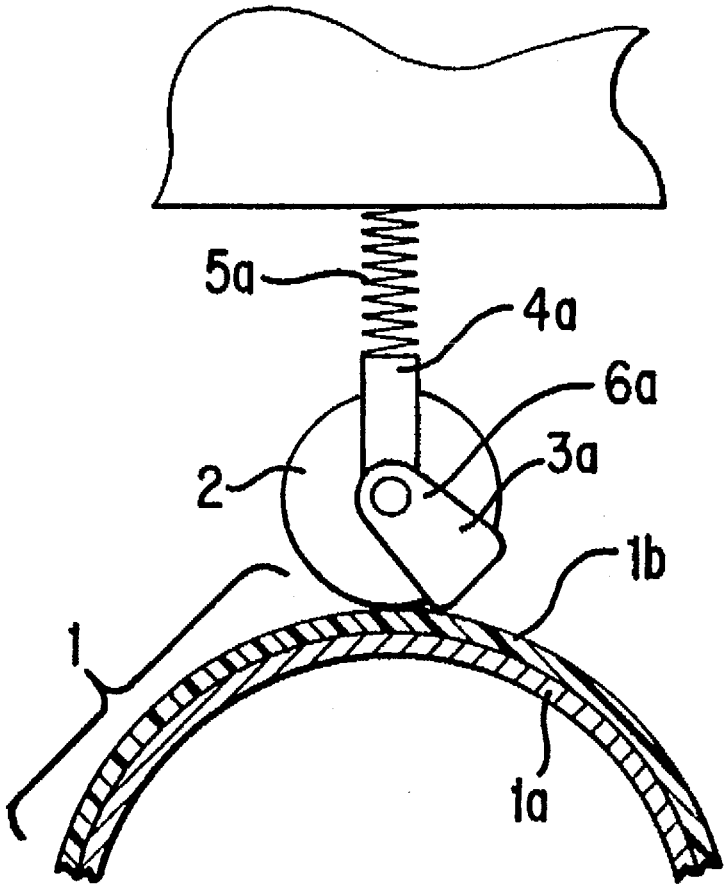
FIG. 3 is a drawing showing a cross section of the OPC drum and the spacer apparatus of this embodiment in the operating position as viewed from an end of the OPC drum.

Shown in FIG. 3 is the position of the spacer cam 3a, the operating position, after the first use of the electrophotographic print cartridge. The clockwise rotation of the OPC drum 1, as viewed from the end shown in FIG. 3, results in spacer cam 3a and spacer cam 3b (not shown in FIG. 3) rotating around shaft ends 2a, 2b in a direction opposite the rotation of OPC drum 1. As spacer cams 3a, 3b (and spacer members 6a, 6b) rotate, compression springs 5a, 5b force charge roller 2 against OPC drum 1 causing further rotation of spacer cams 3a, 3b about shaft ends 2a, 2b. Throughout the life of the electrophotographic print cartridge, spacer cams 3a, 3b remain in the operating position shown in FIG. 3 in contact with the surface of OPC drum 1 as it rotates.

As one skilled in the art of cam design will recognize, the geometry of spacer cams 3a, 3b must be adapted to each application to achieve the desired performance. For example, if spacer cams 3a, 3b had protruding lobes on the edge into which OPC drum 1 rotates so that the distance from the pivot axis of the spacer cams 3a, 3b to the surface of the spacer cams 3a, 3b at the protruding lobes was greater than the distance from the pivot axis to the closest point on the surface of the OPC drum 1, the spacer cams 3a, 3b may not rotate out of the pre-use position and allow charge roller 2 to contact the surface of OPC drum 1 if the coefficient of friction between the OPC drum 1 and the spacer cams 3a, 3b is not sufficiently great to overcome the force exerted by compression springs 5a, 5b or if amount of travel available for charge roller holders 4a, 4b is not large enough.

Another consideration in the design of the spacer cams 3a, 3b is the coefficient of friction between the surface of the spacer cams 3a, 3b and the contacting surface of OPC drum 1. If the coefficient of friction is not great enough, spacer cams 3a, 3b may not rotate out of the pre-use position to the operating position and allow charge roller 2 to contact the surface of OPC drum 1, depending upon the force exerted by compression springs 5a, 5b. Yet another consideration in the design is compatibility of the materials from which the spacer cams 3a, 3b are constructed with the material forming the photoconductive coatings 1b of OPC drum 1. If the abrasiveness of the surface of spacer cams 3a, 3b which contacts OPC drum 1 is too great, the OPC drum 1 surface will be removed down to the aluminum substrate 1a, generating particles which may result in print defects. Additionally, if the material contains chemicals which may out gas and condense on the surface of OPC drum 1 or leach out onto the surface of OPC drum 1, damage may result to OPC drum 1.

Figure 4:
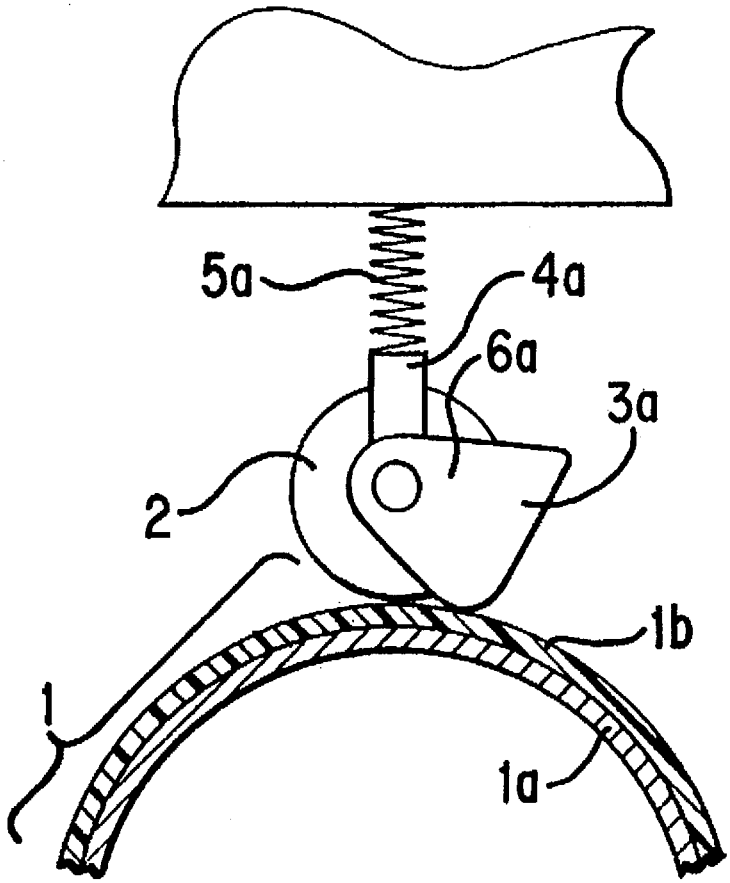
FIG. 4 is a drawing showing a cross section of the OPC drum and a first alternative embodiment of the spacer apparatus as viewed from an end of the OPC drum.

A first alternative of the spacer apparatus of this embodiment is shown in FIG. 4 located in the operating position. In this embodiment spacer cams, 3a, 3b have a corner in the shape of a section of an ellipse. Spacer cams 3a, 3b of this shape will allow the separation of the pre-use position between charge roller 2 and OPC drum 1 to be re-established by rotating the spacer cams 3a, 3b in the direction opposite the movement of the surface 1b of OPC drum 1. It will be recognized that the specific shape necessary to allow spacer cams 3a, 3b to be rotated from the operating position to the pre-use position will depend upon factors which include the coefficient of friction between the spacer cam and the OPC drum 1 surface, the loading force applied by compression springs 5a, 5b to charge roller 2, and the drum radius. Allowing the re-establishment of the pre-use separation may be desirable if the electrophotographic cartridge will not be in use for extended periods of time.

A second alternative of the spacer apparatus of this embodiment would control the coefficient of friction between the surface 1b of OPC drum 1 and the surface of spacer cams 3a, 3b which contacts OPC drum 1 so that the spacer cams 3a, 3b will not rotate out of the pre-use position until the rotational speed of the OPC drum 1 approaches the operating rotational rate in the laser printer. When OPC drum 1 is rotated at rotational speeds substantially below this operating rotational rate, the bottom surface of spacer cams 3a, 3b slides over the surface 1b of OPC drum 1 as OPC drum 1 rotates. When the rotational speed of OPC drum 1 approaches the operating rotational speed the coefficient of friction increases to a value which causes spacer cams 3a, 3b to rotate to the operating positions.

For implementation of each of the previously disclosed embodiments in an electrophotographic print cartridge a modification may be beneficial to improve ease of manufacturing. It is a common practice to perform a visual inspection of the OPC drum after installation into the electrophotographic print cartridge. This visual inspection is done to detect damage to the OPC drum which may have occurred during the handling or installation of the OPC drum. Performing this inspection requires rotation of the OPC drum which, for electrophotographic print cartridges containing the disclosed spacer apparatus, would result in spacer cams 3a, 3b moving to the operating position. To prevent this holes may be made through spacer members 6a, 6b and, in a location corresponding to spacer members 6a, 6b located in the pre-use position, through the cartridge housing. Pins may be inserted through the cartridge housing into spacer members 6a, 6b to prevent movement to the operating position when the OPC drum is rotated for inspection.

Figure 5:
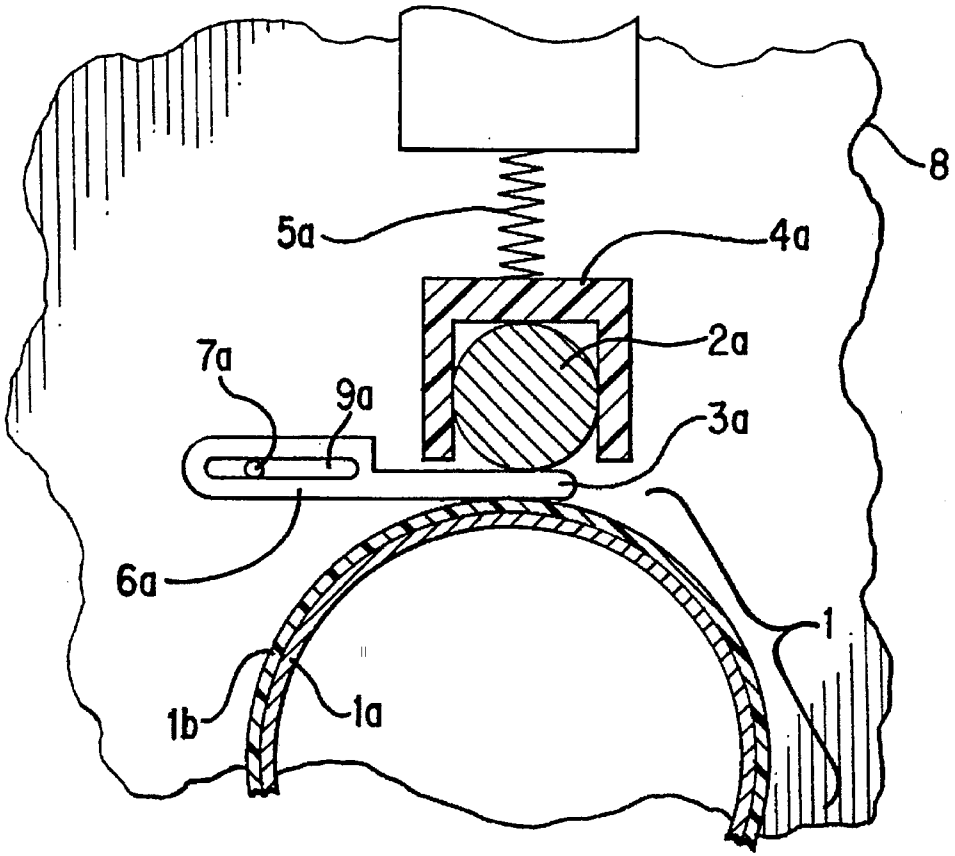
FIG. 5 is a drawing showing a cross section of the OPC drum and a third alternative embodiment of the spacer apparatus as viewed from the middle of the OPC drum.

FIG. 5 shows a third alternative embodiment of the spacer apparatus at one end of OPC drum 1. The spacer apparatus is implemented in similar fashion at the other end of OPC drum 1. In this embodiment the spacer, including spacer member 6a and spacer cam 3a, is slidably mounted on pin 7a attached to housing 8 of the electrophotographic print cartridge. One end of space member 6a contains a slot 9a in which pin 7a is inserted to retain the spacer member 6a. The other end of spacer member 6a contacts shaft shaft 2a in the pre-use position. In the pre-use position, spacer cam 3a contacts the surface of OPC drum 1 so that a gap exists between charge roller 2 and the surface of OPC drum 1. When OPC drum 1 is rotated, frictional forces between the surface of OPC drum 1 and spacer cam 3a moves spacer cam 3a, as constrained by pin 7a, until it is no longer positioned between the shaft 2a and the surface of OPC drum 1. This would allow compression springs 5a, 5b to force charge roller 2 into contact with the surface of OPC drum 1.

U.S. Pat. No. 5,465,136, issued to Watanabe discloses a process cartridge with a charging member pressure contact release feature. A pair of pressure release pieces hold the charging member so that separation exists between the charging member and the image forming member. These pressure release pieces are pivotally mounted on the frame of the process cartridge. When the pieces are rotated, the charging member is forced against the image forming member. Rotation of the pieces may be done manually prior to installation of the process cartridge or automatically as the process cartridge is installed in the imaging system by using features on the imaging system.

U.S. Pat. No. 5,095,335, issued to Watanabe et al., discloses utilizes a mechanism to selectively place a charging member in contact with an image forming member responsive to the insertion of a cartridge into an image forming apparatus. The mechanism is attached to the cartridge housing and rotates the charging member between a position in which it is in contact with the image forming member and a position in which there is separation between the charging member and the image forming member.

In contrast to the devices disclosed in these patents, in the disclosed embodiments of the spacer apparatus the charging member is placed in contact with the image forming member through the rotation of the image forming member. Additionally, the spacer apparatus is either pivotally mounted on the shaft of the charging member or slidably mounted on the housing of the cartridge or image forming system. The disclosed embodiments of the spacer apparatus are significantly less complicated and therefore less costly to implement than those disclosed in the previously mentioned patents.

Although several embodiments of the invention have been illustrated, and their forms described, it is readily apparent to those skilled in the art that various modifications may be made therein without departing from the spirit of the invention or from the scope of the appended claims.

What is claimed is:

1. In an electrophotographic image forming system, including an image forming member and a charging member, a spacer apparatus comprising:

a spacer disposed in a first position between said charging member and said image forming member; and a means for moving said spacer from said first position to a second position responsive to rotation of said image forming member, said means for moving coupled to said spacer.

2. The spacer apparatus as recited in claim 1 wherein:

said electrophotographic image forming system includes an electrophotographic printing system, said image forming member includes a photoconductor drum, and said charging member includes a charge roller having a shaft with said spacer disposed between said shaft and said photoconductor drum.

3. The spacer apparatus as recited in claim 2 wherein:

said shaft includes a first end and a second end; and said spacer includes a first and a second spacer member for contact with said shaft proximal to, respectively, said first end and said second end of said shaft.

4. The spacer apparatus as recited in claim 3, wherein:

said means for moving includes a first and a second spacer cam for contacting said photoconductor drum, attached, respectively, to said first and second spacer member.

5. The spacer apparatus as recited in claim 4, wherein:

said first and said second spacer member each include pivotal mounting to, respectively, said first and said second end of said shaft.

6. The spacer apparatus as recited in claim 4, wherein:

said first and said second spacer members include, respectively a first and a second hole for insertion, respectively, of said first and said second end of said shaft.

7. The spacer apparatus as recited in claim 6, wherein:

said first and said second spacer cam include, respectively, a first and a second surface for frictional contact with said photoconductor drum for forcing said first and said second spacer cam to move from said first position to said second position responsive to rotation of said photoconductor drum.

8. The spacer apparatus as recited in claim 7, wherein:

a gap exists between said charge roller and said photoconductor drum with said first and said second spacer cam in said first position and said charge roller contacts said photoconductor drum with said first and said second spacer cam in said second position.

9. The spacer apparatus as recited in claim 8, wherein:

movement of said first and said second spacer cam from said first position to said second position occurs responsive to rotation of said photoconductor drum at a predetermined rate.

10. The spacer apparatus as recited in claim 9, wherein:

said first and said second surface of said first and said second cam includes a shape for allowing said first and said second spacer cam to move from said second position to said first position.

11. The spacer apparatus as recited in claim 10, wherein:

a cross section of said first and said second surface of said first and said second spacer cam includes an elliptical shape.

12. An electrophotographic print cartridge, comprising:

a photoconductor drum;

a charge roller having a shaft;

a means for separating located between said photoconductor drum and said shaft of said charge roller; and a means for removing said means for separation from between said photoconductor drum and said shaft of said charge roller coupled to said means for separating.

13. The electrophotographic print cartridge as recited in claim 12, wherein:

said shaft includes a first and a second end; and said means for separating includes a first and a second spacer member for contacting, respectively, said shaft proximal to said first and said second end.

14. The electrophotographic print cartridge as recited in claim 13, wherein:

said means for removing moves said first and said second spacer member from a first position to a second position responsive to the rotation of said photoconductor drum.

15. The electrophotographic print cartridge as recited in claim 14, further comprising:

a cartridge housing for enclosing said photoconductor drum and said charge roller; and said means for removing includes a first and a second mounting pin attached to said cartridge housing and a first and a second slot in, respectively, said first and said second spacer member for insertion of said first and said second mounting pin.

16. The electrophotographic print cartridge as recited in claim 14, wherein:

said means for removing includes a first and a second spacer cam attached, respectively, to said first and said second spacer member and for contacting said photoconductor drum.

17. The electrophotographic print cartridge as recited in claim 16, wherein:

pivotal mounting couples said first and said second spacer member to said first and said second end of said shaft.

18. The electrophotographic print cartridge as recited in claim 17, wherein:

said first and said second spacer member include, respectively, a first and a second hole for insertion of said first and said second end of said shaft.

19. The electrophotographic print cartridge as recited in claim 18, wherein:

separation exists between said charge roller and said photoconductor drum for said first and said second spacer member located in said first position; and said charge roller contacts said photoconductor drum for said first and said second spacer member located in said second position.

20. The electrophotographic print cartridge as recited in claim 19, wherein:

said first and said second spacer cam include, respectively, a first and a second surface for frictional contact with said photoconductor drum for forcing said first and said second spacer cam to move from said first position to said second position responsive to rotation of said photoconductor drum.

* * * * *